US005894613A

United States Patent [19]

Fenn

[11] Patent Number: 5,894,613

[45] Date of Patent: Apr. 20, 1999

[54] FAUCET ESCUTCHEON AND MOUNTING MEMBER THEREFOR

[75] Inventor: Mark C. Fenn, Akron, Ohio

[73] Assignee: Moen Incorporated, North Olmsted, Ohio

[21] Appl. No.: 08/926,019

[22] Filed: Sep. 9, 1997

[51] Int. Cl.[6] ..... E03C 1/04

[52] U.S. Cl. ..... 4/678; 4/675; 137/359

[58] Field of Search ..... 4/678, 675, 676, 4/677; 137/801, 359, 360, 606

[56] References Cited

U.S. PATENT DOCUMENTS

| | | | |
|---|---|---|---|
| 4,356,574 | 11/1982 | Johnson | 4/676 |
| 5,291,622 | 3/1994 | Humpert | 4/678 |
| 5,388,287 | 2/1995 | Tischler et al. | 4/678 |
| 5,566,707 | 10/1996 | Ching et al. | 4/676 |
| 5,642,755 | 7/1997 | Mark et al. | 4/676 |

*Primary Examiner*—David J. Walczak
*Attorney, Agent, or Firm*—Dorn, McEachran, Jambor & Keating

[57] ABSTRACT

A faucet escutcheon and mounting member therefor includes an escutcheon having a generally central opening for a faucet body and a defined shape surrounding the faucet body opening. The mounting member has a defined shape similar to that of the escutcheon and dimensionally smaller whereby the mounting member is located within the confines of the escutcheon when both are mounted on a sink deck. The mounting member has a plurality of outwardly extending flexible fingers in yielding contact with the interior of the escutcheon whereby when said escutcheon and mounting member are positioned on a sink deck there is essentially no movement therebetween.

8 Claims, 2 Drawing Sheets

FAUCET ESCUTCHEON AND MOUNTING MEMBER THEREFOR

THE FIELD OF THE INVENTION

The present invention relates to a mounting for faucets, either lavatory faucets or kitchen faucets. In prior art faucet mounting systems, there may be a mounting member which serves to support and position the escutcheon, but conventionally there may be an undesirable degree of movement between these two members both as they are packaged and in the finally installed faucet. A package that rattles has been viewed by customers as an indication of lower quality. Some manufacturers attach components by screws while in the package to avoid this perception.

The present invention provides a mounting member which supports the escutcheon from the underneath side and has a plurality of springlike elements about its periphery which tend to center the escutcheon on the mounting member and locate both elements about the faucet body to prevent any relative movement therebetween. Thus, the escutcheon will be firmly held upon the sink deck, there will be no movement between it and the sink deck or between it and the mounting member which will be held to the sink deck. The mounting fingers which extend outwardly from the support element or mounting element have a sufficient degree of flexibility so as to bridge the small dimensional difference between the inside of the escutcheon and the exterior of the mounting member.

SUMMARY OF THE INVENTION

The present invention relates to an escutcheon and mounting member for use in mounting faucets either on a lavatory basin or on a kitchen sink deck.

A primary purpose of the invention is to provide a mounting member which will support the escutcheon and provide sufficient loading to the escutcheon so as to resist movement of the escutcheon when installed on a sink deck.

Another purpose is a faucet and escutcheon combination as described which provides for a firm mounting of the escutcheon, inhibits any movement of the escutcheon relative to the faucet body and supports the underside of the escutcheon.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The invention will be described in connection with a kitchen faucet sold by the assignee of the present application, Moen Incorporated of North Olmsted, Ohio, under the trademark MANOR. This faucet is designed for use on a kitchen sink deck. The invention is equally applicable to other types or shapes of faucets and to faucets which may be used on a lavatory basin as well as other locations such as on a roman tub. What is important in the present invention is the mounting member for the escutcheon and the manner in which the mounting member provides firm support for the underside of the escutcheon and centers and locates the escutcheon relative to the opening in the sink deck for the faucet body and for the cold and hot water inlet connections.

Figure 1:
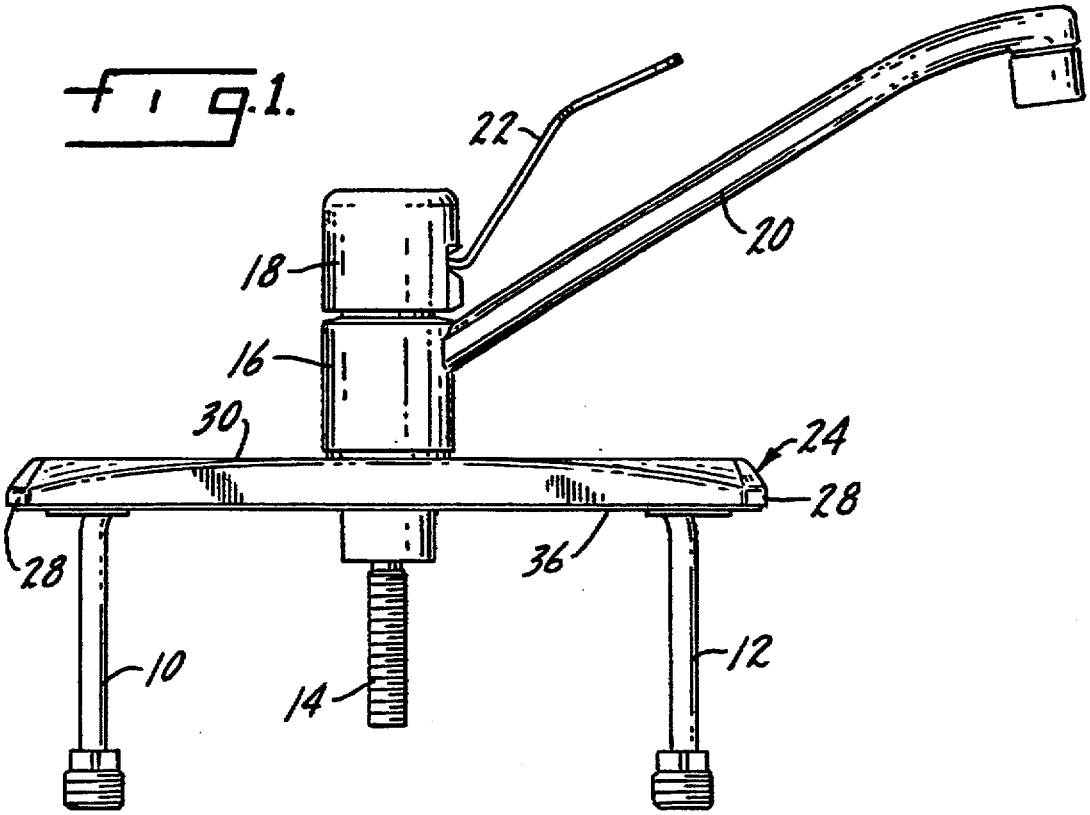
FIG. 1 is a side elevation of a faucet showing the escutcheon and water connections for the faucet body.

As shown in FIG. 1, there are hot and cold water inlet conduits 10 and 12 and a generally central conduit 14, which in the case of a kitchen faucet, may be the connection to a hand-held spray. The faucet body is positioned within a rotatable housing indicated generally at 16 with the cap 18 on the housing 16 being rotatable to control the temperature of the water discharged through a spout 20. A handle 22 is used to manipulate the cap and the raising and lowering of the handle is effective to control the volume of water discharged through the spout.

Figure 2:
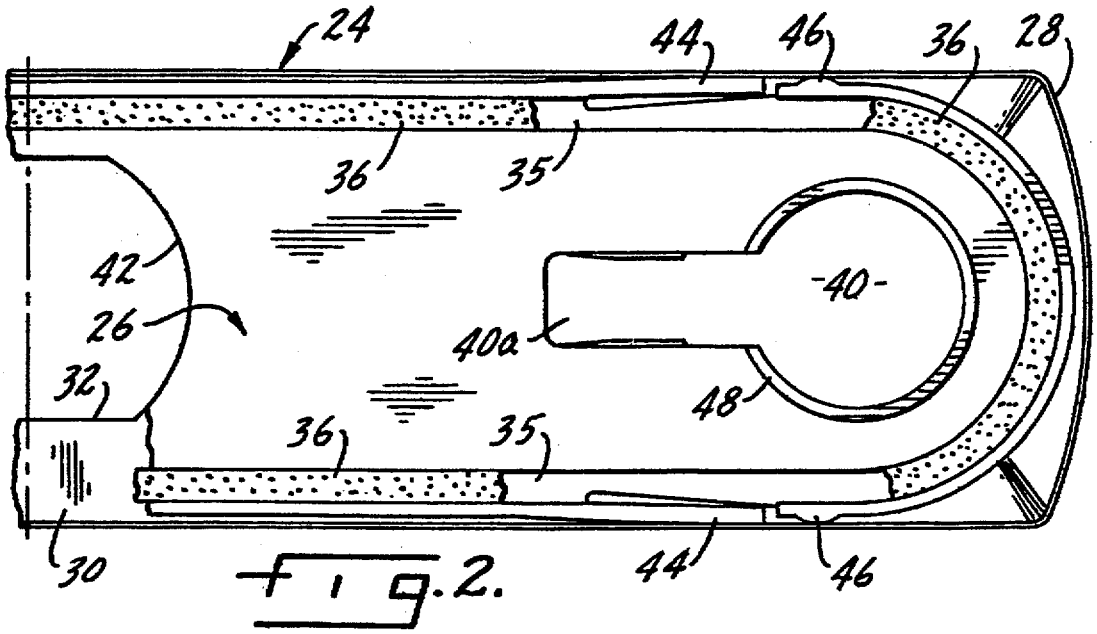
FIG. 2 is an enlarged bottom view of a portion of the mounting member and escutcheon.

The escutcheon is indicated generally at 24 and the mounting member is indicated generally at 26. The escutcheon, as indicated by the partial bottom view of FIG. 2 and by the side view of FIG. 1, has a generally rectangular cross section, with slightly rounded ends 28. In plan, the escutcheon has upwardly curved ends which have the same general curvature as the sides of the generally rectangular escutcheon as indicated in the side view of FIG. 1. The escutcheon has a generally flat upper surface 30 and a central opening 32 for positioning the escutcheon about the faucet body which is within the housing 16 and the cap 18. What has been described above is conventional in the art and the purpose of the present invention is to provide a secure mounting and support for the escutcheon 24.

Figures 3, 4, 5:
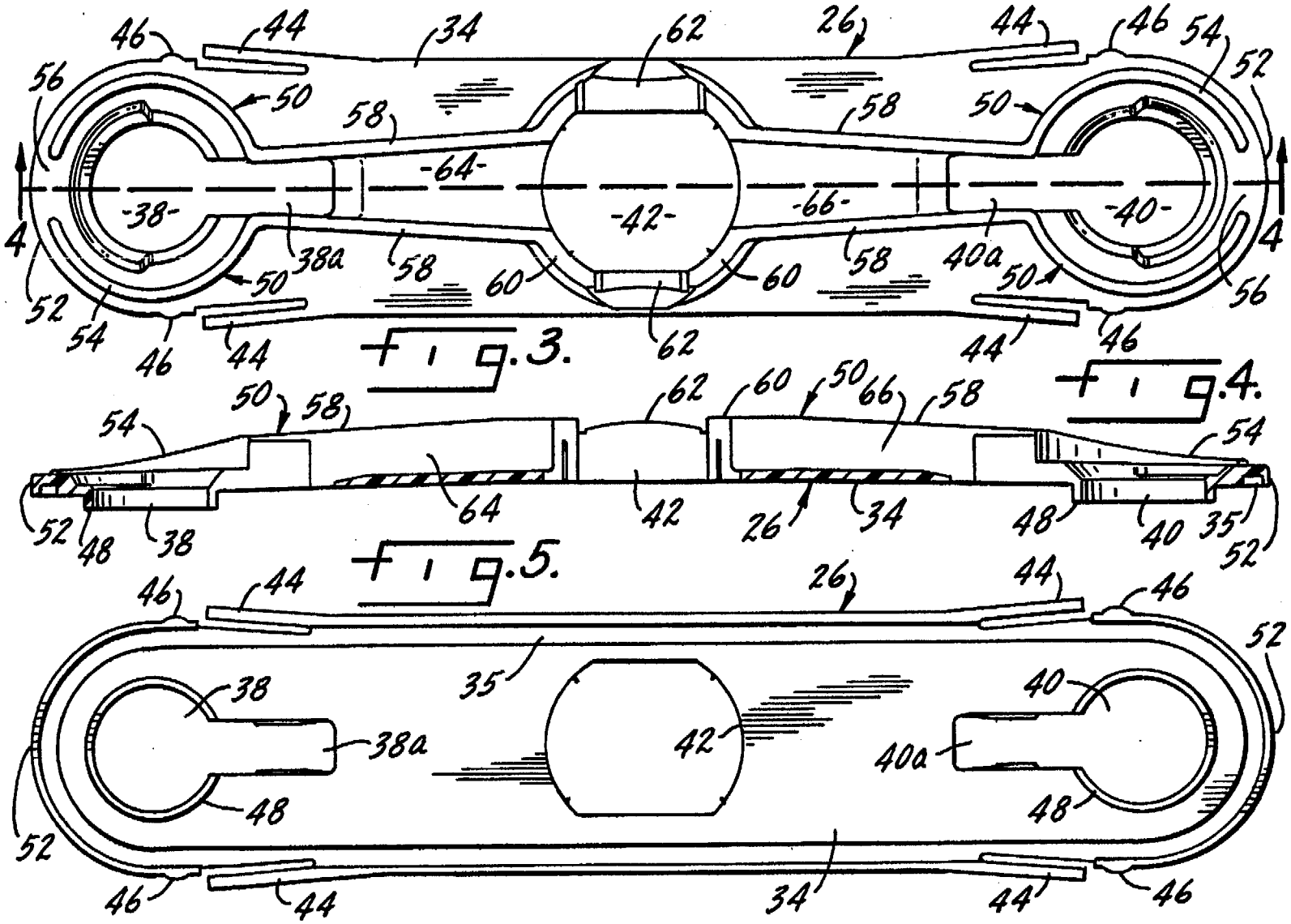
FIG. 3 is a top view of the mounting member.
FIG. 4 is a section along plane 4—4 of FIG. 3.
FIG. 5 is a bottom view of the mounting member.

The mounting member 26 as particularly shown in FIGS. 3, 4 and 5, has a dimensionally similar shape to that of the escutcheon 24 in that it is slightly rectangular with rounded ends. The mounting member 26 has a body 34, the underside of which may have a peripheral groove 35 within which is mounted a sealing element 36. The sealing element will be pressed down upon the sink deck when the connections for the hot and cold water inlet conduits are drawn up tight against the bottom of the sink deck. The mounting member 26 may have a pair of openings 38 and 40 with somewhat rectangular portions thereof 38*a* and 40*a* extending generally toward a central opening 42. The extensions 38*a* and 40*a* will accommodate the inlet and outlet conduits as described hereinafter. The opening 42 is in alignment with the general central opening 32 in the escutcheon so that the escutcheon and mounting member are concentric with the faucet valve. The mounting member may be formed of a suitable plastic, although this is not essential.

Extending peripherally outwardly from the mounting member 26, generally adjacent the ends thereof, are a plurality, in this case four, cantilever spring fingers 44 which have a degree of flexibility and in the unflexed position will extend dimensionally a distance such that the fingers must be pressed toward the body 34 in order for the mounting member to fit within the escutcheon. Thus, the yielding spring fingers 44 will serve to center and properly locate the mounting member within the escutcheon and will prevent movement therebetween. Adjacent each of the fingers 44 there is an outwardly extending bump or projection 46, as clearly shown in FIG. 5, and which, as shown in the bottom view of FIG. 2, will bear against the inside of the escutcheon side walls.

There is a downwardly extending boss 48 about each of the inlet openings 38 and 40 and these bosses will rest upon the sink deck when the mounting member and escutcheon are drawn down securely upon the sink deck when the faucet is mounted.

As particularly shown in FIG. 3, there are support members for the underside of the escutcheon. These support members gradually increase in height from adjacent the openings 38 and 40 toward the opening 42. The support members are symmetrical and consist of spaced walls 50. Each end of a wall 50 has a circular portion 54, gradually tapering toward the rounded ends 52 of the mounting member, with a gap 56 being formed between each wall portion 54. The circular portions 54 gradually increase in height toward a somewhat straight interior portion 58 which terminates in a circular section 60 which will directly support the underside of the escutcheon. Between each of the circular portions 60 there is a thickened support area 62 which will be used to position and hold a part of the faucet body.

The combination escutcheon and mounting member provides not only support for the central area of the escutcheon which may be stamped from a thin metal, but also provides a centering, locating and stabilizing effect so that the escutcheon will not move relative to its underlying support nor relative to the sink deck. The troughs 64 and 66, which are formed between the straight portions 58 of the support walls 50, provide a means for enclosing the water tube conduits 10 and 12 from openings 38 and 40 to the central opening 42 where they will be connected in a conventional manner to the faucet body. This central opening 42 and its aligned opening 32 in the escutcheon provide not only for the faucet body but also for the side spray conduit 14. The somewhat rectangular extensions 38*a* and 48*a* of the inlet conduits 38 and 40 of the mounting member also are designed to accommodate a portion of the inlet conduits as they are bent from the vertical position shown in FIG. 1 to a generally horizontal position where they connect to the faucet body.

Whereas the preferred form of the invention has been shown and described herein, it should be realized that there may be many modifications, substitutions and alterations thereto.

The embodiments of the invention in which an exclusive property or privilege is claimed are defined as follows:

1. A faucet escutcheon and mounting member therefor, said escutcheon having an opening for a faucet body and a defined shape surrounding the faucet body opening, said escutcheon having a periphery and an interior surface, an area of the escutcheon around the faucet body opening being raised from the escutcheon periphery, said mounting member having a periphery similar in shape to that of said escutcheon and dimensionally smaller whereby said mounting member is located within the periphery of said escutcheon when both are mounted on a sink deck, said mounting member having a plurality of outwardly extending flexible positioning members in yielding contact with the interior surface of said escutcheon whereby when said escutcheon and mounting member are positioned on a sink deck there is essentially no movement therebetween, said mounting member including a raised central section for supporting the interior surface of said escutcheon about its faucet body opening, said mounting member including a plurality of symmetrically upwardly extending support elements which have a gradually increasing height from adjacent the periphery of said mounting member toward the center thereof.

2. The faucet escutcheon and mounting member of claim 1 wherein the opening therein is generally centrally located.

3. The faucet escutcheon and mounting member of claim 1 wherein said mounting member positioning members are flexible fingers extending outwardly therefrom around the periphery thereof.

4. The faucet escutcheon and mounting member of claim 3 wherein said flexible fingers are uniformly positioned about the periphery of said mounting member.

5. The faucet escutcheon and mounting member of claim 3 wherein there is a projection adjacent each finger.

6. The faucet escutcheon and mounting member of claim 1 wherein said escutcheon and mounting member have a generally rectangular configuration, with said support elements extending generally parallel to the longest dimension of said support member.

7. The faucet escutcheon and mounting member of claim 6 wherein said mounting member includes a pair of openings, one adjacent each end thereof, with said support elements forming a trough from said openings to the generally central opening for a faucet body whereby said trough may contain conduits connecting to a faucet body.

8. The faucet escutcheon and mounting member of claim 1 wherein the bottom of said mounting member has a bottom with a peripheral groove, and a sealing element positioned within said groove.

* * * * *